United States Patent [19]

Atkiss et al.

[11] 4,057,440

[45] Nov. 8, 1977

[54] SCALE REDUCER FOR ZINC PHOSPHATING SOLUTIONS

[75] Inventors: Thomas Clifford Atkiss, Pottstown; William Elgin Keen, Jr., Flourtown, both of Pa.

[73] Assignee: Pennwalt Corporation, Philadelphia, Pa.

[21] Appl. No.: 653,679

[22] Filed: Jan. 29, 1976

[51] Int. Cl.[2] ..... C23F 7/10

[52] U.S. Cl. ..... 148/6.15 Z; 148/6.27

[58] Field of Search ..... 148/6.15 R, 6.15 Z, 148/6.27; 252/389 A, DIG. 17; 260/502.4 P, 570.6

[56] References Cited

U.S. PATENT DOCUMENTS

| | | | |
|---|---|---|---|
| 3,336,221 | 8/1967 | Ralston | 210/58 |
| 3,459,600 | 8/1969 | Sedlak | 148/6.15 Z |
| 3,738,937 | 6/1973 | Kausky | 252/180 |
| 3,778,377 | 12/1973 | Clark | 252/389 A |
| 3,816,517 | 6/1974 | Krueger et al. | 252/DIG. 17 |
| 4,000,012 | 12/1976 | Burrows et al. | 148/6.15 Z |

*Primary Examiner*—Ralph S. Kendall
*Attorney, Agent, or Firm*—R. G. Danehower

[57] ABSTRACT

The hard rock-like scale formed on zinc phosphating equipment is rendered soft and dispersible by adding a scale-reducing amount of dialkyl triamine pentakis methylene phosphonic acid or its alkaline salt in the zinc phosphating solution.

4 Claims, No Drawings

SCALE REDUCER FOR ZINC PHOSPHATING SOLUTIONS

BACKGROUND OF THE INVENTION

Zinc phosphate coatings are deposited on metals by chemical reaction with an acidic solution of zinc dihydrogen phosphate. The zinc phosphate coating by itself provides a measure of protection against atmospheric and other sources or corrosion. More importantly, the zinc phosphate coatings are combined with an organic top coat such as a paint or lacquer to provide additional corrosion protection and an attractive finish. Heavy deposits of zinc phosphate on metals are also used as a carrier for soaps and other lubricants for deep drawing of metals.

A chronic problem associated with the formation of zinc phosphate coatings on metal is the build up of a hard rock-like scale on heating elements, headers, nozzles and the tank used to hold the phosphating solution. If spray nozzles are being used to apply the phosphating solution the scale build-up decreases the amount of spray, changes the spray patterns and gives non-uniform coatings. Excessive build-up on heating coils acts as an insulating medium and leads to poor heat transfer and eventual shut-down of the phosphating operation. Cleaning of the heating coils is a costly time consuming operation and damage to the coils occurs frequently.

To remove this hard scale and sludge build-up is a major maintenance problem which requires shutting down and phosphating line at frequent intervals. The hard rock-like scale is quite difficult to remove from the equipment and may require use of air hammers and/or aqueous solutions of mineral acids to assist in the scale-removal operation.

In addition to reducing the amount of hard sludge formed on the phosphating equipment the ideal sludge reducer must be compatible with the zinc phosphate concentrates used to prepare and replenish the phosphating baths so that the sludge reducer can be added as a part of the phosphating chemicals. This compatibility has the advantage of insuring that a proper concentration of sludge reducer is always in the phosphating bath, and in addition it makes unnecessary a separate chemical addition and chemical control to maintain the proper concentration of the sludge reducer in the phosphating bath. It is, of course, essential that the sludge reducer does not interfere with the weight or quality of the phosphate coating which is deposited on the metal work piece.

We have now discovered that if we add a small amount of a dialkyl triamine pentakis methylene phosphonic acid or its alkali metal or ammonium salt to the zinc phosphating solution that the phosphate scale and sludge formed as a result of the phosphating reaction is greatly decreased in amount, is non-hardening and is easily removed from the equipment by rinsing with water. The terms scale and sludge have the same meaning and are used interchangeably throughout this specification.

DETAILED DESCRIPTION OF THE INVENTION

The sludge reducer of our invention is applicable to the zinc phosphatizing solutions used to phosphate iron, steel, galvanized steel and aluminum. Zinc is the most widely used metal for depositing heavy weight phosphate coatings. By heavy weight phosphate coatings are coating weights ranging from about 400 to 2500 milligrams per square foot. For prepaint applications, the coating weights are about 50 to 400 milligrams per square foot.

The zinc phosphating solutions and zinc phosphating aqueous concentrates used to prepare the phosphatising solutions of this invention may be prepared and used as described in U.S. Pat. No. 3,619,300 which is incorporated herein by reference. Zinc phosphating baths will be aqueous solutions containing from about 2 to 40 grams per liter of zinc and about 1 to 75 grams per liter of phosphate ion calculated as $PO_4$. Nitrate ion may be present at a concentration ranging from 0 to about 50 grams per liter calculated as $NO_3$. Nitrite may be present at a concentration ranging from 0 to about 1.0 gram per liter calculated as $NO_2$.

Other additives may be used in the phosphating solution for special effects. For example nickel ion may be used in phosphating solutions for prepaint applications to obtain increased corrosion resistance at concentrations ranging from 0 to about 1.5 grams per liter. Fluoride ion is desirable for application of the phosphating solutions to zinc or aluminum surfaces and may be present at a concentration ranging from 0 to about 1 gram per liter.

The phosphate sludge reducer of our invention is dialkyl triamine pentakis methylene phosphonic acid or its alkaline salts in which the alkyl groups range from about $C_2$ to $C_8$. A preferred material is diethyl triamine pentakis methylene phosphonic acid. The sludge modifier may be used as the acid or supplied as the alkali metal or ammonium salt.

The dialkyl triamine pentakis methylene phosphonic acid sludge reducer is used in the phosphating solutions described above at a sludge reducing amount, that is an amount which will reduce the normal amount of sludge formed by ninety percent or more by weight. We have found that the minimum concentration of the sludge reducer will be about 0.05 grams per liter. The concentration of the dialkyl triamine pentakis methylene phosphonic acid or its alkali metal or ammonium salt will generally be present in the range of about 0.05 to about 3 grams per liter. Higher concentrations can be used without obtaining any increase in the amount of sludge reduction. A preferred concentration of the sludge reducer in the phosphating bath will be about 0.07 grams per liter.

The zinc phosphating solution is acidified with phosphoric and/or nitric acids. The phosphating baths are operated at about 5 to 75 total acid points. A total acid point is determined by titrating a 5.0 ml. sample of the bath to phenolphthalein end point with 0.1 N. sodium hydroxide, the milliliters of NaOH used being equal to the total acid point concentration.

The aqueous concentrates which are the materials sold in commerce will be acidic aqueous solutions containing about 75 to 200 grams per liter of zinc ion, about 75 to 500 grams per liter of phosphate ion usually obtained from phosphoric acid and 0 to about 250 grams per liter of nitrate usually obtained from nitric acid. Other additives as described above may be used as desired. Nitrite is always added to the bath as a separate addition. These concentrates are then diluted with water to prepare the phosphating baths.

The phosphonic acid sludge reducer is incorporated in the liquid concentrate used to prepare the zinc phosphating bath in a sludge-reducing amount. As indicated previously, thus is the amount required to obtain at least a ninety percent by weight reduction in hard sludge formation. This quantity will vary to some extent depending on the concentration of other ions such as zinc, nitrate, nitrite and phosphate. The minimum concentration of the sludge-reducer is about 0.7 grams per liter. The concentration range of the dialkyl triamine pentakis methylene phosphonic acid will be about 0.7 to 15 grams per liter in the concentrate. Concentrations higher than 15 grams per liter will not give any greater amount of sludge reduction in the phosphating bath. These concentrates are then diluted with water to prepare and/or to replenish the phosphating baths. The use of the sludge reducer in the phosphating bath does not change in any manner the normal operation of the phosphating bath except to make infrequent the shut-down to remove sludge.

The presence of our sludge reducer in the phosphating bath reduces the build-up of hard rock-like scale on the phosphating equipment and converts it into a water rinsable sludge with only a fraction of the previously obtained hard scale accumulating. At a concentration of as little as 0.0675 grams per liter of dialkyl triamine pentakis methylene phosphonic acid salt gave a sludge reduction of 96.5 percent weight. Surprisingly, we found that the sludge reduction was uniformly high at 96 to 96.5 percent when the concentration of the sludge reducer ranged from about 0.05 to about 3 grams per liter in the phosphating bath.

As mentioned previously, the most convenient way to maintain the proper concentration of the sludge reducer in the phosphating bath is to incorporate the sludge reducer in the materials used to make up the original bath and the concentrates used to replenish the bath. In this manner, as the phosphating chemicals are consumed in the phosphating bath the periodic addition of replenisher chemicals which contain the sludge modifier in the proper relationship to the phosphating chemicals insures its proper concentration in the use baths.

We also discovered that the dialkyl triamine pentakis methylene phosphonic acid sludge reducer is soluble and stable in the phosphating concentrates thereby ensuring a satisfactory shelf-life for the concentrates. Also, we were unable to detect any significant difference in either the quality or weight of the phosphate coatings obtained from phosphating solutions containing a sludge-reducing amount of the dialkyl triamine pentakis methylene phosphonic acid as compared to identical phosphating solutions without the sludge reducer.

The best mode of practicing our invention will be apparent from a consideration of the following examples.

EXAMPLE 1

A zinc phosphating bath was prepared in a stainless steel tank from liquid concentrate having the following average composition:

| | |
|---|---|
| Phosphoric acid (75%) | 33.3%, |
| nitric acid (38° Be) | 26.8%, |
| zinc oxide | 15.7%, |
| water | 24.2% |

all percentages being by weight. The concentrate was diluted with 6.4 times its weight of water to give a phosphating bath containing about 1.69% zinc and 3.17% phosphate as $PO_4$ ion. Titration of the bath with one-tenth normal sodium hydroxide showed that the bath had a total acidity of 35 points, a free acid of 7.5 points and an acid ratio of 4.7 to 1. The nitrite content titrated at 1.2 points based on titration of a 25 ml. sample with 0.05N potassium permanganate.

A stainless steel heating coil was weighed and immersed in the above zinc phosphating bath to obtain a representative sludge deposit in zinc phosphating baths. Steam was applied to the coil until the zinc phosphating solution reached a temperature of 180° F. Steel wool was then added to break in the bath. The stainless steel heating coil remained immersed in the bath at 180° F for 24 hours. After the 24 hour period the steam coil was removed, thoroughly spray rinsed with water, dried and weighed. This procedure was repeated for several measurements.

The average weight of the residual hard sludge deposited on the steam coil for the 24 hour period was found to be 77, 317 milligrams per square foot.

EXAMPLE 2

Varying amounts of diethyl triamine pentakis methylene phosphonic acid sodium salt sludge reducer were added to separate portions of the liquid concentrate used in example 1 as shown below.

| Liquid Zinc Concentrates | | | | |
|---|---|---|---|---|
| Sludge Reduer (% by weight) | 0.01 | 0.05 | 0.1 | 1.0 |
| Sludge Reducer (grams/liter) | 0.15 | 0.765 | 1.53 | 15.3 |

Portions of these liquid concentrates were then diluted with water to prepare zinc phosphating solutions. Following the procedure used in Example 1, the stainless steel heating oil was cleaned, weighed and then immersed in the phosphating solutions having varying concentrations of the sludge reducer as shown in the table below. After 24 hours immersion at 180° F. the coil was removed and the reduction in the amount of scale formation was determined by weighting the coil and comparing it with the scale formation without any sludge-reducer additive.

| Zinc Phosphating Solutions | | | | |
|---|---|---|---|---|
| Concentration of Sludge Reducer (grams/liter) | 0.0135 | 0.0675 | 0.135 | 1.35 |
| Weight of Sludge (grams) | 1.39 | 0.09 | 0.09 | 0.13 |
| Sludge coating (milligrams/sq. ft.) | 33,900 | 2190 | 2190 | 3170 |
| Percent Sludge Reduction | 56 | 96.5 | 96.5 | 96.0 |

EXAMPLE 3

The following series of tests were conducted to determine if the presence of the sludge reducer in the zinc phosphating baths had any adverse effect on the zinc phosphate coatings. To determine this, a series of panels were phosphate coated without the sludge reducer additive being present and then a series of panels were coated in which the sludge reducer additive was present using identical apparatus, procedures and concentrations in the phosphating process.

Four by four inch Q panels (10—10 cold rolled steel) were treated by cleaning in a non-silicated cleaner at a concentration of 6 oz. per gallon for five minutes at a rolling boil temperature, then spray rinsed with water at room temperature for 10 seconds, then immersed in a 10% sulfuric acid solution at 160° F. for 5 minutes, and finally sprayed rinsed with water at room temperature for 10 seconds.

The test panels were then phosphate coated for five minutes in a freshly prepared zinc phosphating bath having the composition used in Example 1. After removal from the phosphate bath the panels were rinsed with water at room temperature for 10 seconds, dried and weighed. The zinc phosphate coating weights from the freshly prepared bath averaged about 1270 milligrams per square foot. Subsequent test panels coated in this bath had coating weights which ranged from 500 to 600 milligrams per square foot.

Using separate portions of the above zinc phosphating bath the diethyl triamine pentakis methylene phosphonic acid sodium salt was added at a concentration of 0.10%, 0.20% and 0.50% by weight of the total active ingredients used to prepare the bath but not including the water used to dilute the concentrates in preparing the phosphating bath. These concentrations are equivalent to 1.55, 3.1 and 7.75 grams of sludge reducer per liter of concentrate. Coating weights obtained with the sludge reducer additive present were 977 milligrams per square foot with the reducer concentration at 0.10% by weight, 800 milligrams per sq. ft. with the sludge reducer additive at a concentration of 0.20% by weight and 820 milligrams per square foot when the sludge reducer additive was present at a concentration of 0.50% by weight. No discernible differences were noted in the quality of the coatings with or without the sludge reducer additive being present.

EXAMPLE 4

The solubility of diethyl triamine pentakis methylene phosphonic acid sodium salt scale reducer was observed in two zinc phosphating concentrates having a zinc content of 12.3 and 12.9% by weight. The scale reducer was added to the zinc phosphate concentrates at a concentration of 0.05% weight equivalent to about 0.7 and 0.8 grams per liter of sludge reducer and placed in a hot room at a temperature of 100° F and held there for 1 month. After removal from the hot room the samples were cooled and then observed for the appearance of any solids. No solids were present in either of the solutions.

To determine if the one month high temperature storage had any adverse effect on the stability of the scale-reducer additive the zinc phosphate concentrates were then diluted with water to prepare a zinc phosphating solution having a composition as described in Example 1. In each case the stainless steel heating coil was exposed to the phosphating solution at a temperature of 180° F for 24 hours. The results of these experiments showed a scale reduction of 92 and 96% respectively indicating that the high temperature storage for 1 month had no adverse effect on the sludge reducing properties of the sludge reducer.

We claim:

1. In the process of phosphating iron, steel, galvanized steel and aluminum with an aqueous acidic zinc phosphating solution the improvement comprising adding a scale-reducing amount of dialkyl triamine pentakis methylene phosphonic acid or its alkaline salt in which the alkyl group ranges from $C_2$ to $C_8$ carbons and the salt is selected from the group consisting of sodium, potassium and ammonium.

2. The process of claim 1 in which the scale-reducing additive is present in the phosphating solution at a concentration of at least about 0.05 grams per liter.

3. In an aqueous acidic concentrate of zinc and phosphate ions for dilution with water to prepare a zinc phosphating solution the improvement comprising the addition of a scale-reducing amount of dialkyl triamine pentakis methylene phosphonic acid or its alkaline salt in which the alkyl group ranges from $C_2$ to $C_8$ carbons and the salt is selected from the group consisting of sodium, potassium and ammonium.

4. The aqueous acidic concentrate of claim 3 in which the scale-reducer additive is present at a concentration of at least about 0.7 grams per liter.

* * * * *